US006498300B2

(12) United States Patent
Flick

(10) Patent No.: US 6,498,300 B2
(45) Date of Patent: Dec. 24, 2002

(54) ELECTRICAL SIGNAL CABLE ASSEMBLY INCLUDING TRANSPARENT INSULATING LAYERS AND ASSOCIATED METHODS

(75) Inventor: Kenneth E. Flick, Douglasville, GA (US)

(73) Assignee: Omega Patents, L.L.C., Douglasville, GA (US)

( * ) Notice: Subject to any disclaimer, the term of this patent is extended or adjusted under 35 U.S.C. 154(b) by 0 days.

(21) Appl. No.: 09/811,022

(22) Filed: Mar. 16, 2001

(65) Prior Publication Data

US 2002/0129968 A1 Sep. 19, 2002

(51) Int. Cl.[7] ..... H01B 7/00

(52) U.S. Cl. ..... 174/110 R; 174/113 R; 174/120 R

(58) Field of Search ..... 174/36, 110 R, 174/110 FC, 112, 113 R, 115, 120 R, 120 AR, 120 SR

(56) References Cited

U.S. PATENT DOCUMENTS 3,710,007 A * 1/1973 Hoeg et al. ..... 174/120 R
4,869,848 A * 9/1989 Hasegawa et al. ..... 252/609
5,082,995 A * 1/1992 Paterson et al. ..... 174/113 R
5,109,140 A * 4/1992 Nguyen ..... 174/36
5,329,065 A * 7/1994 Marney et al. ..... 174/128.1
5,831,210 A * 11/1998 Nugent ..... 174/27
5,900,589 A * 5/1999 Brunt ..... 174/120 R
5,922,996 A * 7/1999 Ryeczek ..... 174/112
6,114,632 A * 9/2000 Planas, Sr. et al. ..... 174/117 R

OTHER PUBLICATIONS

Richard J. Lewis, Sr. Hawley's Condensed Chemical Dictionary, Copyright Date Oct. 1997, Thirteenth Edition, pp. 906 & 908.*

* cited by examiner

*Primary Examiner*—Anthony Dinkins
*Assistant Examiner*—William H. Mayo, III
(74) *Attorney, Agent, or Firm*—Allen, Dyer, Doppelt, Milbrath & Gilchrist, P.A.

(57) ABSTRACT

An electrical signal cable assembly includes an electrical cable having opposing first and second ends connected to first and second electrical connectors respectively, and wherein the cable includes at least three wire members arranged in a non-interlaced configuration. Each wire member may include at least one metallic conductor and a respective individual insulating layer thereon. Each of the metallic conductors, in turn, may include at least one of silver and copper at a purity of greater than about 90 percent. An overall insulating layer may surround the three wire members to retain them in position without requiring braiding. In addition, the overall insulating layer and the individual plastic insulating layer are preferably transparent to show a metallic color of the metallic conductors therethrough.

42 Claims, 3 Drawing Sheets

ELECTRICAL SIGNAL CABLE ASSEMBLY INCLUDING TRANSPARENT INSULATING LAYERS AND ASSOCIATED METHODS

FIELD OF THE INVENTION

The present invention relates to electrical signal cables, and, more particularly, to a high performance electrical signal cable assembly and associated manufacturing methods.

BACKGROUND OF THE INVENTION

Overtime home entertainment systems have grown increasingly better in terms of performance. Users have grown accustomed to high quality audio and video. Indeed, audiophiles and videophiles expect continuing improvements in the underlying technology to thereby yield improvements in the replication of audio and/or video entertainment.

An audio and/or video system may typically include a signal source, such as DVD player, etc. which generates signals based upon very accurate digital encoding. This digital coding may be converted into a low level analog signal, for example, to be delivered to a downstream power amplifier or switcher, for example. Certain signal sources may also transmit the signals in a digital form.

A cable assembly including a pair of connectors and a length of multiconductor cable is typically used to connect the audio and/or video signal source to the downstream power amplifier or signal switcher. The signals traveling along the cable may be effected by external noise sources, such as broadcast transmitters, wireless telephones, cellular telephones, etc. Internal material resistance may also effect the signals. Noise and distortion caused by the cable assembly become more significant as the quality and performance of the other related components continues to improve.

Relatively high performance cables including expensive conductor alloys and balanced configurations have been developed. The balanced configurations attempt to avoid the distortion which may occur in unbalanced systems, such as based on coaxial technology which include an overall shield surrounding one or more interior conductors. A coaxial cable may also have a relatively high capacitance and series inductance also leading to signal distortion.

An example of a high performance balanced cable is offered by Kimble Kable under the model designations AGDL and KCAG. The cables include three wire members arranged in a braided or interlaced construction. Each wire member may include a copper or silver conductor, and its own insulation layer. Various insulating materials including Teflon™, polypropylene, polyethylene, polyvinyl chloride, silicone and others may be used. The braided arrangement is intended to keep the wire members together.

Unfortunately, one difficulty with the braided arrangement is that the braids may have a tendency to separate, especially adjacent the connectors. This makes handling more difficult and may adversely effect electrical performance. In addition, the cables require relatively complex braiding machinery which adds to the expense of the finished cable assembly.

SUMMARY OF THE INVENTION

In view of the foregoing background, it is therefore an object of the present invention to provide a high quality cable assembly that avoids wire member separation at the connectors, and which is more readily manufactured than conventional braided cables.

This and other objects, features and advantages in accordance with the present invention are provided by an electrical signal cable assembly including an electrical cable having opposing first and second ends connected to first and second electrical connectors respectively, and wherein the cable includes at least three wire members arranged in a non-interlaced configuration. More particularly, each wire member may comprise at least one metallic conductor and a respective individual insulating layer thereon. Each of the metallic conductors, in turn, may comprise at least one of silver and copper at a purity of greater than about 90 percent. Moreover, at overall insulating layer preferably surrounds the three wire members to retain them in position without requiring braiding. In addition, the overall insulating layer and the individual insulating layers are preferably transparent to show a metallic color of the metallic conductors therethrough.

In one embodiment, the non-interlaced configuration may comprise a helical configuration. Of course, the helical configuration may include portions with opposing rotational directions. In one class of embodiments, the at least three wire members comprises three wire members with centers defining vertices of an imaginary equilateral triangle at a given position along the cable.

The at least one metallic conductor of each wire member may comprise a single metallic conductor. Alternately, the at least one metallic conductor of each wire member may include a stranded metallic conductor.

The at least one metallic conductor of at least one wire member may comprise silver, such as silver at a purity of at least about 99.7 percent. Similarly, the at least one metallic conductor of at least one wire member may comprise copper. The copper may also be a relatively high purity of at least about 99.7 percent. Of course, both types of metal can be used in other cable embodiments.

The overall insulating layer may be directly on the three wire members so that the cable is devoid of a conductive shield. Accordingly, the cable retains its electrically balanced nature, and manufacturing is simplified.

Each of the individual insulating layers may comprise polytetrafluoroethylene, or Teflon®, for example. The overall insulating layer may comprise polyvinyl chloride. Other plastics may also be used. The overall insulating layer may have a generally round outer shape which facilitates manufacturing and which may also make installation easier.

A method aspect of the invention is for making an electrical signal cable assembly. The method may include forming at least three wire members each comprising at least one metallic conductor and a respective individual transparent insulating layer thereon. Each of the metallic conductors may comprise at least one of silver and copper at a purity of greater than about 90 percent. The method may also include arranging the three wire members in a non-interlaced configuration, and forming an overall transparent insulating layer surrounding the three wire members to define an electrical cable. Also the method may include connecting first and second electrical connectors to respective opposing first and second ends of the electrical cable.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime notation is used for similar elements in alternate embodiments.

Figure 1:
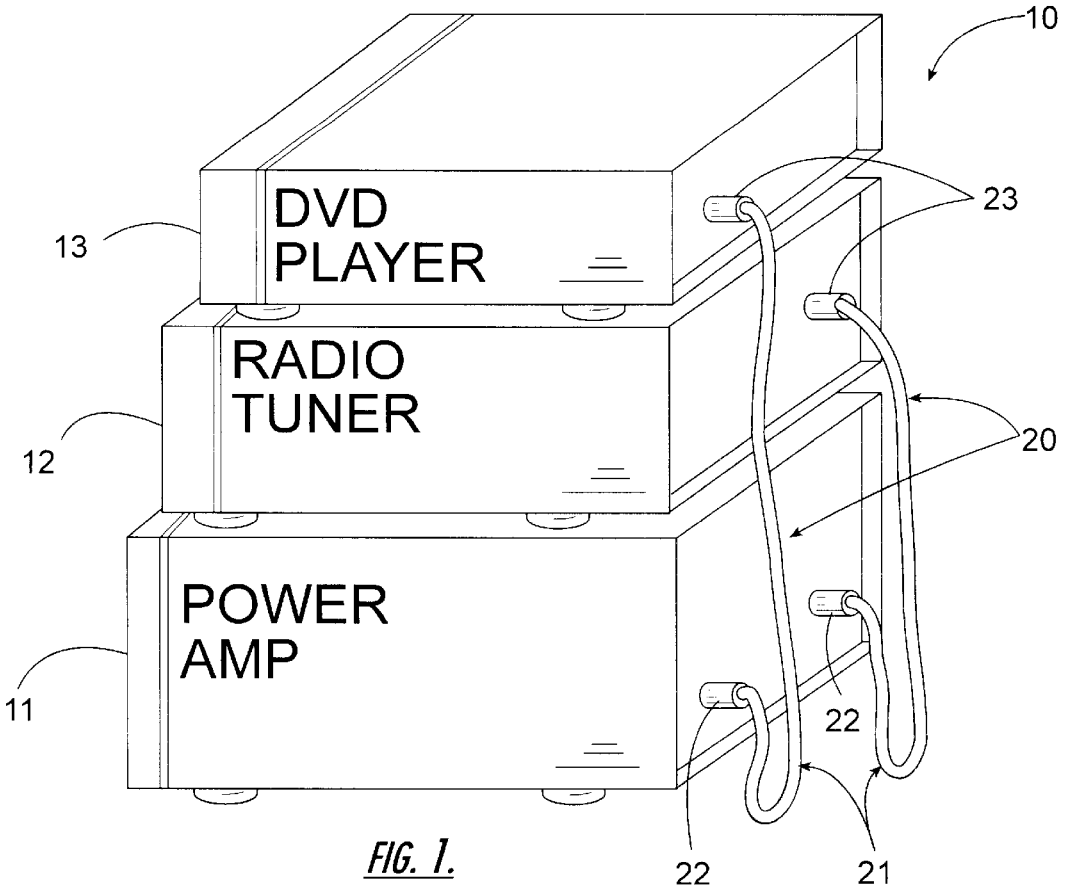
FIG. 1 is a perspective view of a portion of a home entertainment system including electrical signal cable assemblies in accordance with the present invention.
Figure 2:
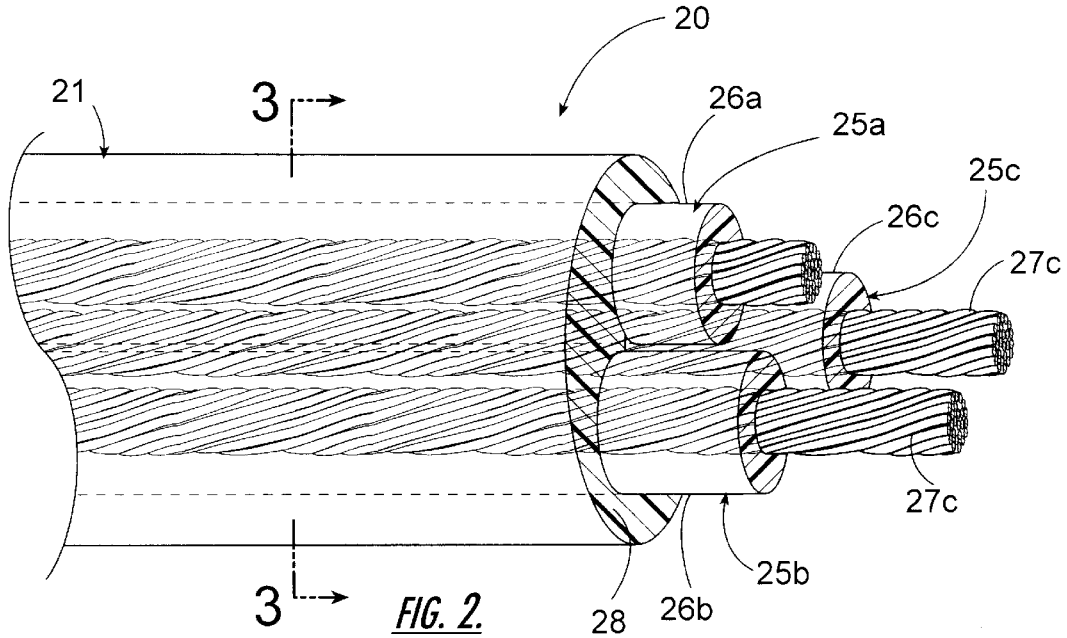
FIG. 2 is a greatly enlarged side view of an end of the electrical signal cable assembly as shown in FIG. 1 with the connector removed therefrom for clarity of explanation.
Figure 3:
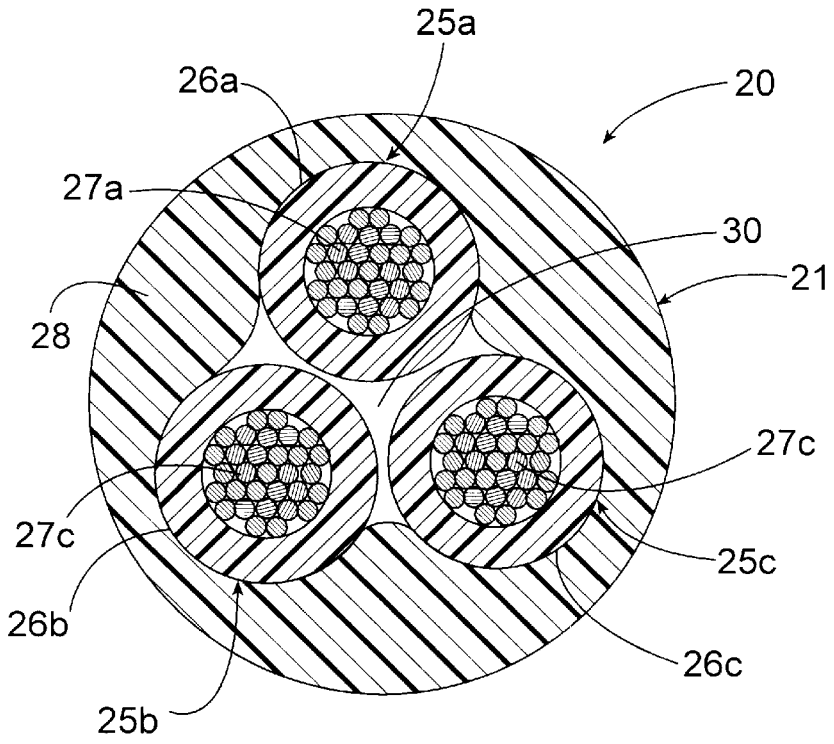
FIG. 3 is a cross-sectional view taken along lines 3—3 of FIG. 2.

Referring initially to FIGS. 1–3, an embodiment of an electrical signal cable assembly 20 in accordance with the present invention is now described as may be used in the illustrated portion of the home entertainment system 10. The home entertainment system 10 illustratively includes a power amplifier 11, a radio tuner 12 and a DVD player 13 arranged in stacked relation. Those of skill in the art will appreciate that the home entertainment system 10 may include substitute and/or additional components which also need to be interconnected using the cable assembly 20 in accordance with the present invention to carry audio and/or video signals.

A first cable assembly 20 illustratively connects an output of the DVD player 13 with an input of the power amplifier 11. Similarly, an output of the tuner 12 is connected to an input of the power amplifier 11 by a second cable assembly 20. Those of skill in the art will recognize that more such cable assemblies would typically be used in a such an entertainment system 10. For example, three cable assemblies may be used to connect the DVD player 13 to the power amplifier 11— a first cable assembly for the left audio channel, a second cable assembly for the right audio channel, and a third cable for the video signal. Other configurations are also contemplated by the present invention.

Referring now more specifically to FIGS. 2 and 3, details of the electrical cable assembly 20 are now provided. The electrical cable assembly 20 includes an electrical cable 21 having opposing first and second ends connected to first and second electrical connectors 22, 23 respectively. The connectors 22, 23 may be of any conventional type, such as RCA, etc. as will be appreciated by those skilled in the art.

The cable illustratively includes three wire members 25*a*–25*c* arranged in a non-interlaced configuration. As shown in the illustrated embodiment, the wire members 25*a*–25*c* have centers arranged to define the vertices of an imaginary equilateral triangle at a give point or position along the cable 21. To facilitate manufacturing as will be explained in greater detail below, the non-interlaced arrangement may include a twist, slightly visible in FIG. 3, to hold the wire members 25*a*–25*c* together during manufacturing. For example, the twist may be such that there is only about a 5 to 10 percent reduction in the length of the electrical cable 21 compared to the actual full lengths of each wire member 25*a*–25*c*. In some embodiments, the twisted, non-interlaced configuration may comprise a helical configuration. The helical configuration may include portions with opposing rotational directions.

In the illustrated embodiment, the number of wire members 25*a*–25*c* is three in number as may be readily used in a large number of applications; however, in other embodiments more than three wire members may be used. Each wire member 25*a*–25*c* illustratively includes a respective stranded metallic conductor 27*a*–27*c* and respective individual insulating layer 26*a*–26*c* hereon. Each of the metallic conductors 27*a*–27*c*, in turn, includes silver or copper at a purity of greater than about 90 percent. This relatively high purity of silver or copper provides the desired relatively low electrical resistance for high signal quality transmission.

An overall insulating layer 28 illustratively surrounds the three wire members 25*a*–25*c* to retain them in position in the cable 21 without requiring braiding, such as used in prior art cables. The overall insulating layer 28 retains the wire members 25*a*–25*c* together so that they do not come a part adjacent the connectors 22, 23 as occurs in braided cable assemblies of the prior art. The overall insulating layer 28 also provides a relatively smooth outer surface to facilitate placement and routing of the cable.

Another advantageous feature of the cable assembly 20 is that the overall insulating layer 28 and the individual insulating layers 26*a*–26*c* are transparent to show the copper or silver metallic color of the conductors 27*a*–27*c* therethrough. This significantly adds to the visual appeal of the cable assembly 20. In other words, the overall insulating layer 28 being transparent allows the metallic color of the conductors 27*a*–27*c* to show through to the user just as in the braided cable assemblies of the prior art. However, the difficulties associated with the prior art braided cables are overcome.

The overall insulating layer 28 as shown in the illustrated embodiment is directly on the three wire members 25*a*–25*c* so that the cable 21 is devoid of a conductive shield. Thus, the cable 21 retains its electrically balanced nature, and manufacturing is simplified.

The cable 21 also illustratively includes an air gap 30 in the center portion thereof. In other embodiments, the material of the overall insulating layer 28 may extend into and partially or completely fill this gap as will be appreciated by those skilled in the art.

The stranded metallic conductors 27*a*–27*c* of one or more of the wire members 25*a*–25*c* may comprise silver, such as silver at a purity of at least about 99.7 percent. Similarly, one or more of the metallic conductors 27*a*–27*c* may comprise copper. The copper may also be a relatively high purity of at least about 99.7 percent. Of course, both types of metal can be used together in other cable embodiments. Both copper and silver have relatively low electrical resistivities and sufficient mechanical properties to be used for the conductors 27*a*–27*c*, although small amounts of other materials may also be included as will be appreciated by those skilled in the art.

Each of the individual insulating layers 26*a*–26*c* may comprise polytetrafluoroethylene, or Teflon®, for example. The overall insulating layer 28 may comprise polyvinyl chloride (PVC) which is readily applied and which can be transparent and provide the other properties desired. Other plastics may also be used for the insulation layers as will appreciated by those skilled in the art.

Each of the stranded electrical conductors 27*a*–27*c* may be generally round and have a diameter in a range of about 0.5 to 3 mm, and more preferably about 1.5 mm. Each wire member 25*a*–25*c* may also be generally round and have a diameter in a range of about 1 to 5 mm, and more preferably about 2.5 mm. All of the wire members 25*a*–25*c* may be the same size, although slight variations are also possible. Lastly, the electrical cable 21, including the overall insulating layer 28 and wire members 25*a*–25*c* contained therein, may also be generally round and have a diameter in a range of about 5 to 10 mm, and more preferably about 6.5 mm.

Figure 4:
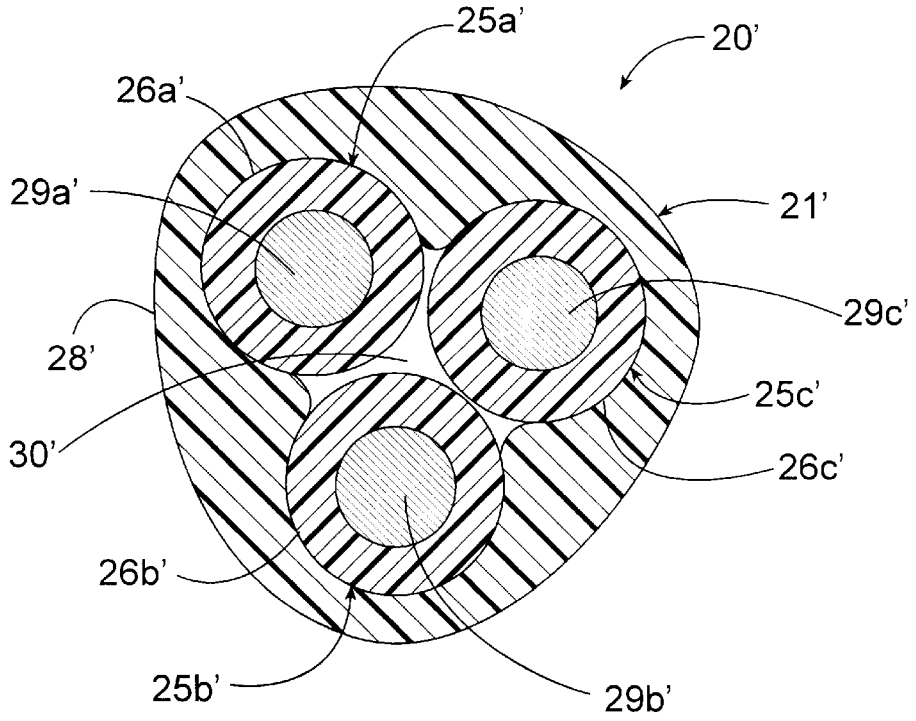
FIG. 4 is a cross-sectional view of an alternate embodiment of the electrical cable assembly in accordance with the present invention.

Referring now briefly to FIG. 4, another embodiment of the electrical signal cable assembly 20' in accordance with the present invention is now described. In this embodiment, the stranded electrical conductors 27*a*–27*c* as shown in FIGS. 2 and 3, are each replaced by a single or solid conductor 29*a'*–29*c'*. The thickness of the solid conductors 29*a'*–29*c'*and the composition thereof can be configured to still ensure sufficiently flexibility.

The cable 21' also includes an overall insulating layer 28' that is slightly triangular in its outer shape. In other words, the overall insulating layer 28' has conformed slightly to the underlying triangular arrangement of wire members 25*a'*–25*c'*. Those other elements of the cable 21' of the cable assembly 20' shown in FIG. 4, are similar to elements described above with reference to FIGS. 2 and 3. These other elements are indicated with prime notation and need no further discussion herein.

Figure 5:
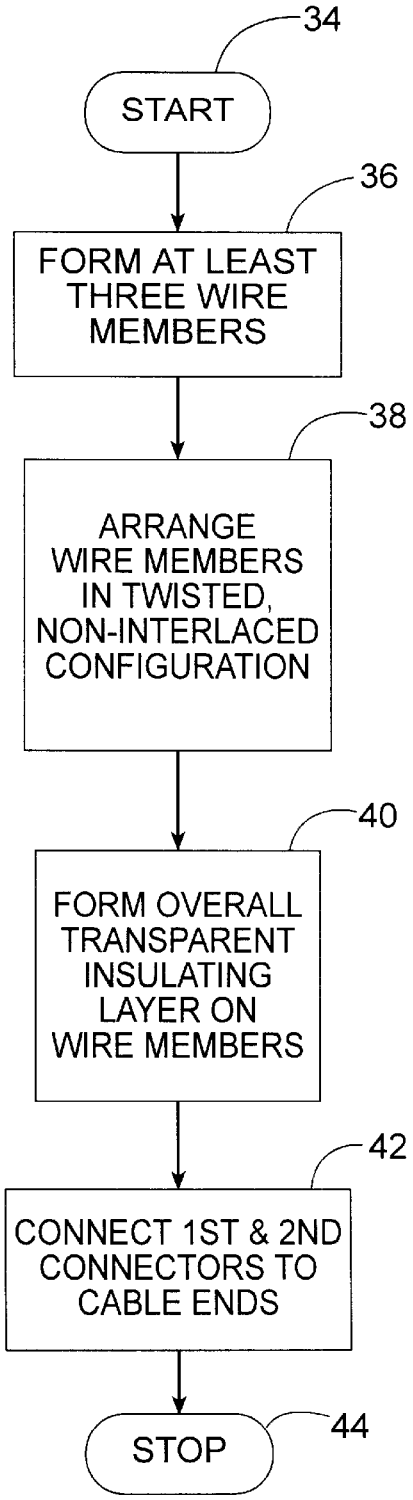
FIG. 5 is a flow chart for the method of making the electrical cable assembly as shown in FIG. 1.

A method aspect of the invention is now explained with reference to the flow chart of FIG. 5. The method is for making an electrical signal cable assembly 20 as described above. From the start (Block 34), the method includes at Block 36 forming at least three wire members 25*a*–25*c* each comprising at least one metallic conductor 27*a*–27*c* and a respective individual transparent insulating layer 26*a*–26*c* thereon. Each of the metallic conductors preferably comprises at least one of silver and copper at a purity of greater than about 90 percent. The insulating layers 26*a*–26*c* may be extruded, for example, onto the respective stranded electrical conductors 27*a*–27*c* as will be appreciated by those skilled in the art.

At Block 38, the method may also include arranging the at least three wire members 25*a*–25*c* in a twisted, non-interlaced configuration. This arrangement provides sufficient cohesion of the wire members 25*a*–25*c* together to facilitate extrusion of the overall transparent insulating layer 28 surrounding the at least three wire members to define an electrical cable 21 at Block 40. The method may also include connecting first and second electrical connectors 22, 23 (FIG. 1) to respective opposing first and second ends of the electrical cable at Block 42 before stopping at Block 44.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and other embodiments are intended to be included within the scope of the claims.

That which is claimed is:

1. An electrical signal cable assembly comprising:

first and second electrical connectors;

an electrical cable having opposing first and second ends connected to said first and second electrical connectors respectively, said electrical cable comprising at least three wire members arranged in a twisted, non-interlaced configuration, each wire member comprising at least one metallic conductor and a respective individual insulating layer thereon, each of said metallic conductors comprising at least one of silver and copper at a purity of greater than about 90 percent, and an overall insulating layer surrounding said at least three wire members, said overall insulating layer and said individual insulating layers being transparent to show a metallic color of said metallic conductors therethrough.

2. An electrical signal cable assembly according to claim 1 wherein said twisted, non-interlaced configuration comprises a helical configuration.

3. An electrical signal cable assembly according to claim 1 wherein said at least three wire members comprises three wire members with centers defining vertices of an imaginary equilateral triangle at a given position along said electrical cable.

4. An electrical signal cable assembly according to claim 1 wherein the at least one metallic conductor of each wire member comprises a single metallic conductor.

5. An electrical signal cable assembly according to claim 1 wherein the at least one metallic conductor of each wire member comprises a stranded metallic conductor.

6. An electrical signal cable assembly according to claim 1 wherein said at least one metallic conductor of each wire member is generally round having an outer diameter in a range of about 0.5 to 3 mm.

7. An electrical signal cable assembly according to claim 1 wherein the at least one metallic conductor of at least one wire member comprise silver.

8. An electrical signal cable assembly according to claim 7 wherein the silver is at a purity of at least about 99.7 percent.

9. An electrical signal cable assembly according to claim 1 wherein the at least one metallic conductor of at least one wire member comprise copper.

10. An electrical signal cable assembly according to claim 9 wherein the copper is at a purity of at least about 99.7 percent.

11. An electrical signal cable assembly according to claim 1 wherein said overall insulating layer is directly on said at least three wire members so that said electrical cable is devoid of a conductive shield.

12. An electrical signal cable assembly according to claim 1 wherein each of said individual insulating layers comprises polytetrafluoroethylene.

13. An electrical signal cable assembly according to claim 1 wherein each of said wire members is generally round having an outer diameter in a range of about 1 to 5 mm.

14. An electrical signal cable assembly according to claim 1 wherein said overall insulating layer comprises polyvinyl chloride.

15. An electrical signal cable assembly according to claim 1 wherein said electrical cable is generally round having an outer diameter in a range of about 5 to 10 mm.

16. An electrical signal cable assembly comprising:

first and second electrical connectors;

an electrical cable having opposing first and second ends connected to said first and second electrical connectors respectively, said electrical cable comprising three wire members arranged in a non-interlaced configuration with centers defining three vertices of an imaginary equilateral triangle at a given position along said electrical cable, each wire member comprising at least one metallic conductor and a respective individual insulating layer thereon, the at least one metallic conductor of at least one wire member comprising silver at a purity of greater than about 90 percent, and an overall insulating layer surrounding and being directly on said three wire members so that said electrical cable is devoid of a conductive shield, said overall insulating layer and said individual insulating layers being transparent to show a metallic color of said metallic conductors therethrough.

17. An electrical signal cable assembly according to claim 16 wherein said non-interlaced configuration comprises a helical configuration.

18. An electrical signal cable assembly according to claim 16 wherein the at least one metallic conductor of each wire member comprises a single metallic conductor.

19. An electrical signal cable assembly according to claim 16 wherein the at least one metallic conductor of each wire member comprises a stranded metallic conductor.

20. An electrical signal cable assembly according to claim 16 wherein the silver is at a purity of at least about 99.7 percent.

21. An electrical signal cable assembly according to claim 16 wherein each of said individual insulating layers comprises polytetrafluoroethylene.

22. An electrical signal cable assembly according to claim 16 wherein said overall insulating layer comprises polyvinyl chloride.

23. An electrical signal cable assembly according to claim 16 wherein said overall insulating layer has a generally round outer shape.

24. An electrical signal cable assembly comprising:

first and second electrical connectors;

an electrical cable having opposing first and second ends connected to said first and second electrical connectors respectively, said electrical cable comprising three wire members arranged in a non-interlaced configuration with centers defining three vertices of an imaginary equilateral triangle at a given position along said electrical cable, each wire member comprising at least one metallic conductor and a respective individual insulating layer thereon, the at least one metallic conductor of at least one wire member comprising copper at a purity of greater than about 90 percent, and an overall insulating layer surrounding and being directly on said three wire members so that said electrical cable is devoid of a conductive shield, said overall insulating layer and said individual insulating layers being transparent to show a metallic color of said metallic conductors therethrough.

25. An electrical signal cable assembly according to claim 24 wherein said non-interlaced configuration comprises a helical configuration.

26. An electrical signal cable assembly according to claim 24 wherein the at least one metallic conductor of each wire member comprises a single metallic conductor.

27. An electrical signal cable assembly according to claim 24 wherein the at least one metallic conductor of each wire member comprises a stranded metallic conductor.

28. An electrical signal cable assembly according to claim 24 wherein the copper is at a purity of at least about 99.7 percent.

29. An electrical signal cable assembly according to claim 24 wherein each of said individual insulating layers comprises polytetrafluoroethylene.

30. An electrical signal cable assembly according to claim 24 wherein said overall insulating layer comprises polyvinyl chloride.

31. An electrical signal cable assembly according to claim 24 wherein said overall insulating layer has a generally round outer shape.

32. A method for making an electrical signal cable assembly comprising:

forming at least three wire members each comprising at least one metallic conductor and a respective individual transparent insulating layer thereon, each of the metallic conductors comprising at least one of silver and copper at a purity of greater than about 90 percent;

arranging the at least three wire members in a twisted, non-interlaced configuration;

forming an overall transparent insulating layer surrounding the at least three wire members to define an electrical cable; and connecting first and second electrical connectors to respective opposing first and second ends of the electrical cable.

33. A method according to claim 32 wherein the twisted, non-interlaced configuration comprises a helical configuration.

34. A method according to claim 32 wherein the at least three wire members comprises three wire members.

35. A method according to claim 32 wherein the at least one metallic conductor of each wire member comprises a single metallic conductor.

36. A method according to claim 32 wherein the at least one metallic conductor of each wire member comprises a stranded metallic conductor.

37. A method according to claim 32 wherein the at least one metallic conductor of each wire member comprise silver.

38. A method according to claim 37 wherein the silver is at a purity of at least about 99.7 percent.

39. A method according to claim 32 wherein the at least one metallic conductor of each wire member comprise copper.

40. A method according to claim 39 wherein the copper is at a purity of at least about 99.7 percent.

41. A method according to claim 32 wherein forming the overall insulating layer comprises forming the overall insulating layer directly on the at least three wire members so that the electrical cable is devoid of a conductive shield.

42. A method according to claim 32 wherein forming the overall insulating layer comprises forming the overall insulating layer to have a generally round outer shape.

* * * * *